United States Patent [19]

Williams

[11] 4,196,341

[45] Apr. 1, 1980

[54] SYSTEM FOR MONITORING THE OPERATION OF AN ELECTRIC BOILER

[76] Inventor: Stanley A. Williams, 10 Durlston Rd., Poole, Dorset BH14 8PQ, England

[21] Appl. No.: 817,966

[22] Filed: Jul. 22, 1977

[30] Foreign Application Priority Data

Jul. 22, 1976 [GB] United Kingdom ..... 30569/76

[51] Int. Cl.[2] ..... H05B 1/02; F22B 37/42; H05B 3/60

[52] U.S. Cl. ..... 219/295; 122/382; 122/504.2; 219/273; 340/526

[58] Field of Search ..... 219/284–295, 219/506, 272, 273; 122/382, 447, 504.2, 379; 340/526

[56] References Cited

U.S. PATENT DOCUMENTS

| | | | |
|---|---|---|---|
| 3,614,278 | 10/1971 | Di Noto | 122/504.2 |
| 3,760,775 | 9/1973 | Williams | 122/382 |
| 3,761,679 | 9/1973 | Dall | 219/272 X |
| 3,937,920 | 2/1976 | Gundacker et al. | 219/295 X |
| 4,070,992 | 1/1978 | Holdt | 122/382 |

*Primary Examiner*—A. Bartis

*Attorney, Agent, or Firm*—Michael J. Striker

[57] ABSTRACT

An electrode steam boiler includes a water-receiving shell and water-heating electrodes supported in the shell so as to be partially immersed in the water to be heated. The boiler also has first and second water-handling means arranged, respectively, for supplying feed water to, and withdrawing water from, the boiler shell, and a current responsive means responsive to the current flowing in one of the electrodes for actuating the two water-handling means. Finally, the boiler has means for monitoring the number of actuations in a pre-set period of at least one of the two water-handling means, and means responsive to this monitoring means for actuating a safety means when this number of actuations in a pre-set period of at least one of the water-handling means exceeds a predetermined value. The safety means may take the form of an audible and/or visual alarm or a device for shutting down the boiler.

6 Claims, 2 Drawing Figures

SYSTEM FOR MONITORING THE OPERATION OF AN ELECTRIC BOILER

Figure 1:
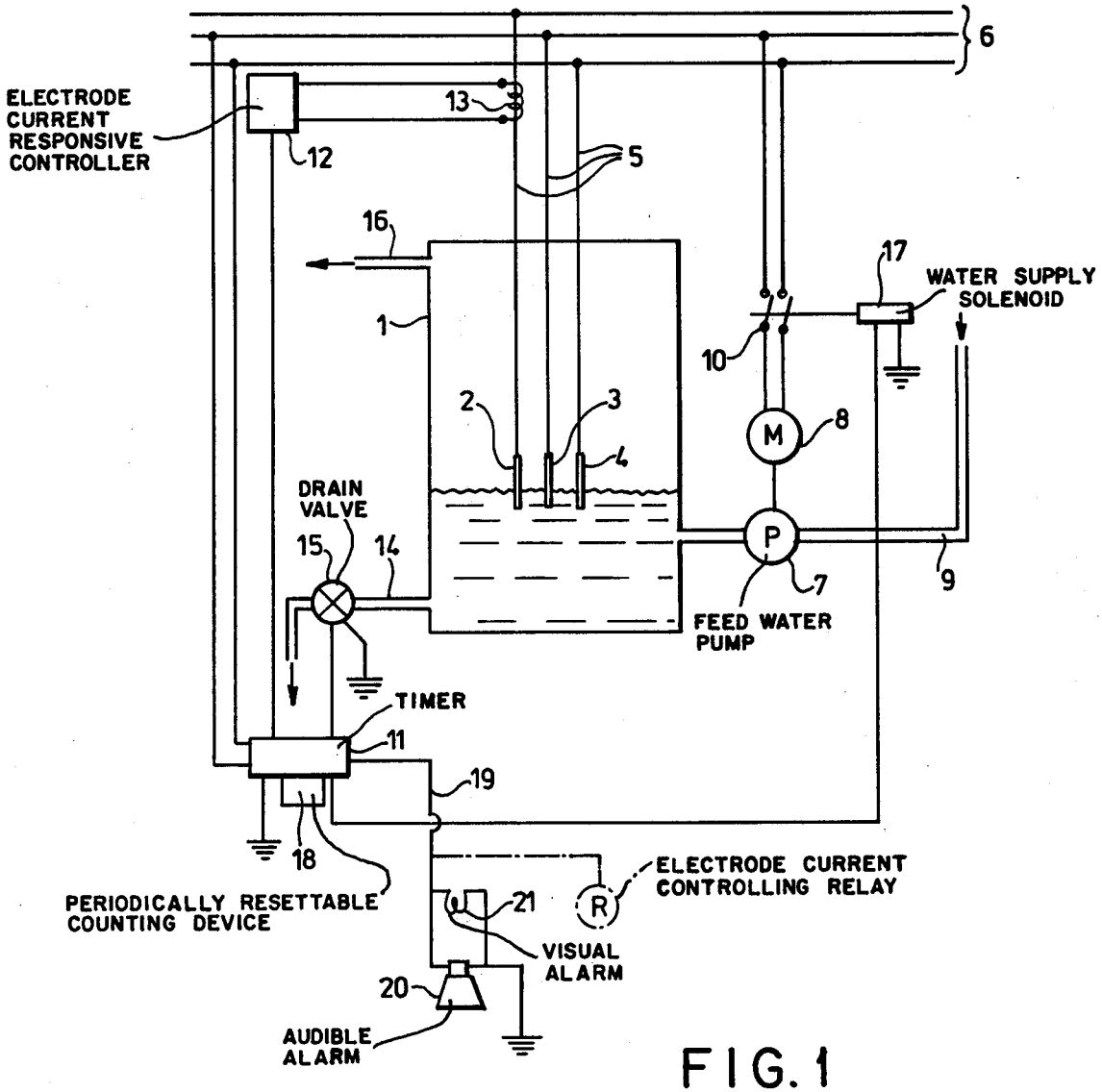

This invention relates to an electrode boiler for generating steam, hereinafter referred to as an electrode steam boiler.

In my U.S. Pat. No. 3,760,775 dated Sept. 25, 1973, there is described and claimed a method of operating an electrode steam boiler of the kind comprising electrodes supported in the boiler, water withdrawal means for withdrawing water from the boiler and feed water supply means for supplying feed water to the boiler. According to the said Patent, the method involves actuating the feed water supply means intermittently and the water withdrawal means is actuated to pass water to waste intermittently with a frequency of actuation which is dependent on the frequency of actuation of the feed water supply means.

It is explained in the aforesaid Patent that, as the concentration of the salts in the water of a electrode steam boiler increases, the intervals of feed water supply occur more frequently although of shorter duration (assuming constant demand for steam from the boiler). Thus, for example, in the case of a boiler containing water with a high concentration of salts, there may be as many as four hundred water supply intervals per hour, whereas with a boiler containing much purer water there may be only one hundred feed water supply intervals per hour.

The operation of an electrode steam boiler for long periods of time with water containing a high concentration of salts can cause damage to the electrodes and possibly to the boiler shell. Although the method described and claimed in the aforesaid Patent results in a periodic improvement of the water in the boiler by intermittently drawing off water containing a high concentration of salts and replacing it with purer water, the degree of improvement is dependent on the quality of the feed water, over which the method has no control. Therefore, even when operated by the method described and claimed in the aforesaid Patent, an electrode steam boiler can operate for extended periods of time with water containing too high a concentration of salts.

According to the present invention, an electrode steam boiler comprises a water-receiving shell and water-heating electrodes supported in this shell so as to be partially immersed in the water to be heated. The boiler has a first water-handling means for supplying feed water to the boiler shell and current responsive means responsive to the current flowing to one of the electrodes for actuating this first water-handling means. The boiler also has a second water-handling means for withdrawing water from the boiler shell and passing it to waste, and means responsive to actuation of the aforesaid current responsive means for actuating this second water-handling means. Finally, the boiler has means for monitoring the number of actuations in a pre-set period of at least one of the two water-handling means, and means responsive to this monitoring means for actuating a safety means when the aforesaid number of actuations in a pre-set period of at least one of the two water-handling means exceeds a predetermined value.

Said means responsive to the monitoring means may be arranged to provide an electrical signal when said number exceeds a predetermined value, which signal may be employed to actuate a safety means for shutting down the boiler, for example by shutting off the supply of fuel to the boiler. In general, however, I prefer to arrange for the signal to actuate an alarm device, which may be visual and/or audible, to alert the boiler operator to the fact that the boiler water contains a dangerously high concentration of salts. The operator can then take steps to investigate the cause of this and rectify the situation.

Said monitoring means may comprise an electric timer containing a counting device. The counting device would be arranged to count the number of actuations in a pre-set period of at least one of the water-handling means, the timer being arranged to re-set the counting device to zero periodically, for example every hour. Said means responsive to the monitoring means may take the form of an adjustable tripping mechanism in the counting device so that if said number of actuations of at least one of the water-handling means exceeds a predetermined number in the set period, said signal is generated.

Clearly, other forms of monitoring means may be employed, instead of the timer and counting device described above for measuring in a pre-set period the number of actuations of at least one of the water-handling means. For example, the electric current required to operate the first and/or the second water-handling means, or a current proportional thereto, may be passed through an electrical thermal overload release device. The thermally-responsive member of the latter will therefore achieve a temperature, when the boiler is in operation, which is dependent on the number of actuations of at least one of the water-handling means. The thermal overload release device would be arranged to trip when its thermally-responsive member reached a temperature corresponding to a number of actuations, in a pre-set period, of at least one of the water-handling means in excess of said predetermined value. The thermal overload release device would be arranged to actuate said safety means when it trips.

In general it is only necessary for the means responsive to the monitoring means to be responsive to actuation of either the first or the second water-handling means, and it is at present preferred that it should be responsive to actuation of the second water-handling means.

Figure 2:
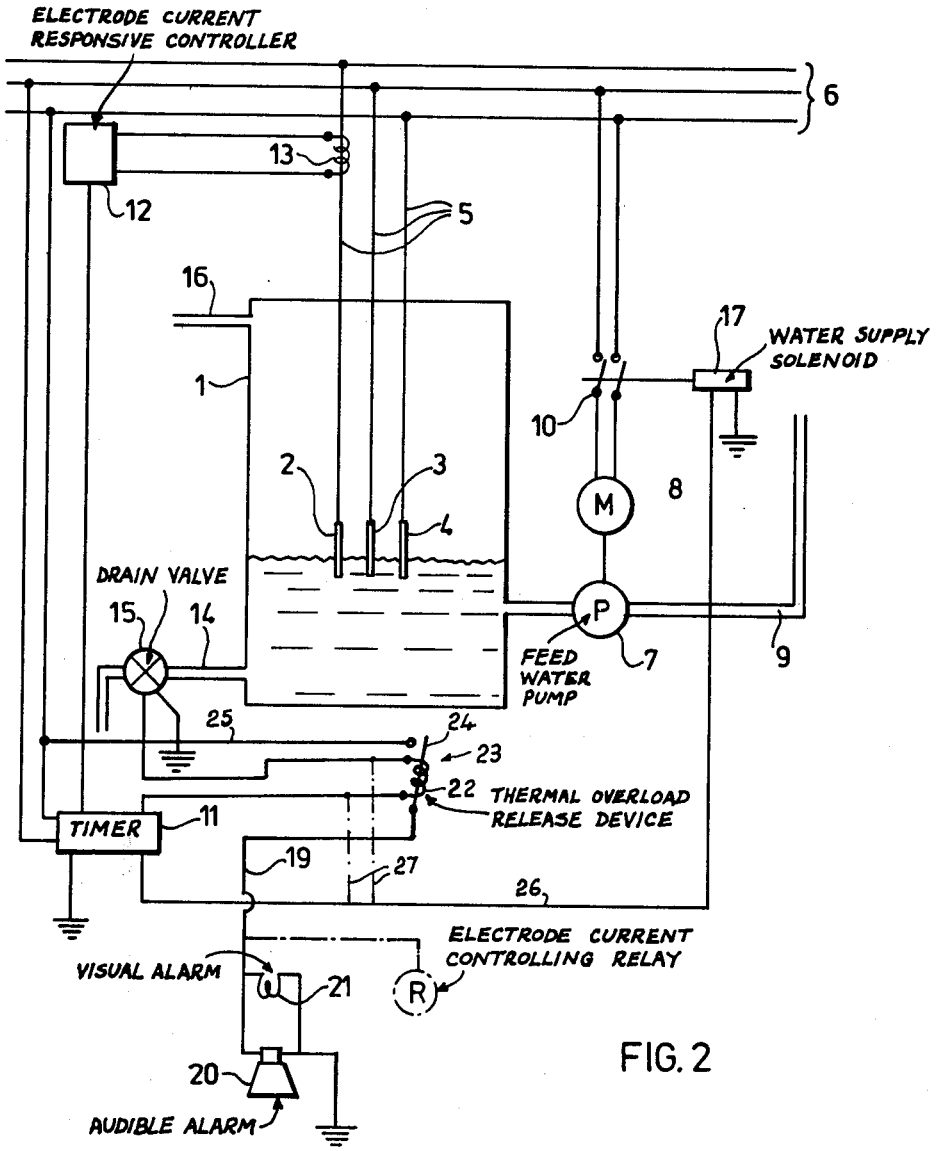

Two embodiments of an electrode steam boiler in accordance with the invention will now be described, by way of example, with reference to the accompanying drawings in which FIG. 1 is a schematic view of the first embodiment employing a resettable counting device and FIG. 2 is a schematic view of the second embodiment employing a thermal overloard release device.

The electrode steam boiler shown in FIG. 1 has a shell 1 in which three electrodes 2, 3, 4 are supported and connected by leads 5 to a 3-phase A.C. supply network 6. A pump 7 driven by an electric motor 8 is arranged to supply feed water to the shell 1 via a pipe 9 from a suitable water source (not shown). The motor 8 is connected to the network 6 via a switch 10.

An electric timer 11 is connected to the network 6 and is controlled by signals received from a controller 12. The latter is supplied with current from a current transformer 13 which responds to the current flowing in one of the electrode supply leads. 5. As the water level in the shell 1 drops, due to generation of steam, the current in the leads 5 will decrease and therefore the current supplied to the controller 12 by the transformer 13 will also decrease. Decrease of the latter current to a predetermined value indicates that feed water should be supplied to the shell 1 to make up for the loss of water caused by the generation of steam. When this predetermined current flows to the controller 12, a signal is sent by the controller to initiate operation of the timer 11 as described more fully hereinafter.

A water outlet pipe 14 is connected to the shell 1 and is provided with an electrically-operated valve 15. The numeral 16 designates the outlet pipe for steam generated in the shell 1.

When the controller 12 sends a signal to the timer 11 indicating the need for water to be supplied to the shell 1, the timer first sends an impulse to the valve 15 and the latter is opened for a predetermined interval of time (which interval is adjustable at the timer) to allow water to flow from the shell through the pipe 14. When the valve 15 closes at the end of this predetermined interval of time, the timer 11 sends a further impulse to a solenoid 17 which closes the switch 10 to operate the pump 7 and supply the feed water to the shell. As the water level builds up in the shell, the current supplied to the controller 12 increases and at a predetermined value of this current the controller 12 sends a signal to the timer 11 to initiate de-energisation of the solenoid 17 so that the switch 10 re-opens to stop the pump 7.

If the feed water supplied to the shell has a higher than usual concentration of salts, then the electrical conductivity of the feed water will be higher than usual. This means that, as feed water is supplied to the shell, the predetermined current which initiates de-energisation of the solenoid 17 occurs with a lower level of water in the shell than usual. This in turn means that the next demand for a supply of feed water will occur sooner than if purer water had been fed to the shell. This situation gradually gets worse, and as the concentration of salts builds up in the boiler the frequency of operation of the feed water pump 7 gradually increases. If this is not noticed by the boiler operator, the boiler can operate for very long periods of time with a dangerously high concentration of salts in the boiler water.

In order to warn the boiler operator of the situation just described, the timer 11 has a counting device 18 incorporated therein and the timer is arranged to send an impulse to the counting device every time the valve 15 is actuated to withdraw water from the boiler. The impulses are counted by the counting device and at pre-set intervals, for example every hour, the timer is arranged to re-set the counting device to zero. The counting device 18 has an adjustable tripping mechanism incorporated therein which is arranged to initiate the generation of an electrical signal if the number of impulses received by the counting device from the timer 11 in any of said pre-set intervals exceeds a given number set on the counting device. For example, if it is found that, with maximum steam demand, the water withdrawal valve 15 is actuated up to 200 times per hour when the concentration of salts in the boiler water is at a satisfactory level, then the adjustable tripping mechanism of the counting device 18 could be set to trip when the counting device has recorded the receipt of 300 impulses from the timer 11. Assuming that the latter has been set to re-zero the counting device 18 every hour, it will be seen that the tripping mechanism of the counting device 18 will not be tripped so long as the concentration of salts in the boiler water only exceeds a satisfactory level by a small amount. If, however, the salt concentration greatly exceeds a satisfactory level, represented by 300 actuations of the valve 15 in a period of less than one hour, then the tripping mechanism will trip.

In the example illustrated in the drawing, tripping of the adjustable tripping mechamism of the counting device 18 results in the timer 11 energising a line 19 which supplies electric current to both an audible alarm 20 and to a visible alarm in the form of a lamp 21. In alternative arrangements the line 19 may instead, or additionally, supply electric current to a relay R which, when actuated, is arranged to cut off the supply of current to the electrodes 2, 3, 4 and so shut down the boiler.

In the above description of FIG. 1 it is stated that the timer 11 is arranged to send an impulse to the counting device 18 every time the valve 15 is actuated to withdraw water from the boiler. As an alternative to this, or in addition, the timer 11 may be arranged to send an impulse to the counting device 18 every time the pump 7 is operated to supply feed water to the shell.

In the embodiment of the boiler shown in FIG. 2, most of the items are the same as in the embodiment of FIG. 1, and the same reference numerals have been used to designate the same items in both Figures. In FIG. 2, the counting device of FIG. 1 is omitted and instead, the timer 11 is connected to the valve 15 via the coil 22 of a thermal overload release device 23 which has a normally-open, thermally-responsive contact 24. The contact 24 is in the line 19 which instead of being connected to the timer 11 as in FIG. 1, is connected to the network 6 via a line 25.

When the controller 12 sends a signal to the timer 11 indicating the need for water to be supplied to the shell 1, the sequence of events is the same as in the case of FIG. 1 as regards the opening and closing of valve 15 and the operation of pump 7. In the FIG. 2 embodiment, however, each impulse sent by the timer 11 to the valve 15 causes heating of the coil 22 of the device 23. Thus, the coil 22 will achieve a temperature which is dependent on the frequency of operation of the valve 15. The device 23 is arranged so that the contact 24 closes when the temperature of the coil 22 rises to a value corresponding to a frequency of operation of valve 15 which is in excess of a predetermined value, indicating excessive concentration of salts in the water in the shell 1. Closing of the contact 24 causes current to be supplied to the alarm 20 and the lamp 21 or to the relay R.

Instead of being connected in the line from the timer 11 to the valve 15, the coil 22 may be connected in the line 26 from the timer 11 to the solenoid 17. This connection is indicated by the chain lines 27 in FIG. 2.

What is claimed is:

1. An electrode steam boiler comprising a water-receiving shell, water-heating electrodes supported in said shell so as to be at least partially immersed in the water to be heated, a first water-handling means for supplying feed water to said shell, control means including means responsive to the magnitude of current flowing to one of said electrodes for actuating said first water-handling means in response to said electrode current falling below a predetermined level to cause feed water to be supplied to said shell, a second water-handling means for withdrawing water from said shell and passing it to waste, said control means including means for actuating said second water-handling means in conjunction with actuation of said first water-handling means, means monitoring the number of actuations in a pre-set period of at least one of said water-handling means, and means responsive to said monitoring means for actuating a safety means when said number of actuations in said pre-set period exeeds a predetermined value.

2. An electrode boiler according to claim 1, wherein said safety means is an electrically actuated means for shutting down the boiler.

3. An electrode boiler according to claim 1, wherein said safety means is an alarm device.

4. An electrode boiler according to claim 1, wherein said monitoring means comprises an electric timer containing a counting-device, said counting device being arranged to count the number of actuations of said at least one water-handling means, and said timer being arranged to re-set said counting device to zero periodically.

5. An electrode boiler according to claim 4, wherein the means responsive to said monitoring means comprises an adjustable tripping mechanism for actuating said safety means.

6. An electrode boiler according to claim 1, wherein said monitoring means and said means responsive to said monitoring means are provided by an electrical thermal overload release device to which is fed a current equal to or proportional to the current required to operate said at least one water-handling means, said thermal overload release device being arranged to trip and actuate said safety means when its thermally responsive member reaches a temperature corresponding to a number of actuations in a pre-set period of said at least one water-handling means in excess of said predetermined value.

* * * * *